US008981879B2

(12) United States Patent
Chen et al.

(10) Patent No.: US 8,981,879 B2
(45) Date of Patent: Mar. 17, 2015

(54) FILTER DEVICE

(75) Inventors: Chia-Jung Chen, New Taipei (TW); Wei-Wen Chan, New Taipei (TW)

(73) Assignee: Grand-Tek Technology Co., Ltd., New Taipei (TW)

( * ) Notice: Subject to any disclaimer, the term of this patent is extended or adjusted under 35 U.S.C. 154(b) by 343 days.

(21) Appl. No.: 13/541,872

(22) Filed: Jul. 5, 2012

(65) Prior Publication Data

US 2013/0033341 A1 Feb. 7, 2013

(30) Foreign Application Priority Data

Aug. 4, 2011 (TW) ..... 100214382 A

(51) Int. Cl.
*H01P 1/202* (2006.01)
*H01P 1/20* (2006.01)

(52) U.S. Cl.
CPC . *H01P 1/202* (2013.01); *H01P 1/20* (2013.01)
USPC ..... 333/206

(58) Field of Classification Search
CPC ..... H01P 1/202; H01P 1/20
USPC ..... 333/202, 206, 207
See application file for complete search history.

(56) References Cited

U.S. PATENT DOCUMENTS 4,680,560 A * 7/1987 Yorita et al. ..... 333/206

* cited by examiner

*Primary Examiner* — Benny Lee
*Assistant Examiner* — Rakesh Patel
(74) *Attorney, Agent, or Firm* — Chun-Ming Shih; HDLS IPR Services

(57) ABSTRACT

The present invention relates to a filter device, the filter device includes a housing provided with a through-hole; and a filter structure includes a signal line; a wave filter connected to the signal line, the size of the periphery of the wave filter smaller than the diameter of the through-hole; a connecter connected to one end of the signal line and connected electrically with the wave filter; wherein the filter structure is arranged from the outside of the housing through the through-hole correspondingly, so that the signal line and the wave filter are arranged at the inside of the housing and the connecter is fixed at the through-hole. Hence, the filter structure is locked and fixed optionally from the outside or from the inside of the housing to increase the convenience of the whole assembly.

12 Claims, 5 Drawing Sheets

FILTER DEVICE

BACKGROUND OF THE INVENTION

1. Field of the Invention

The present invention relates to an electronic product provided with a wave filter, and in particular to a filter device.

2. Description of Prior Art

The conventional dual-band module integrated device has a plurality of first antennas and second antennas; and an electronic equipment equipped with the dual-band module integrated device can receive required wireless signals by the first antennas and the second antennas. The problems of the conventional dual-band module integrated device can be explained with the assumption that the first antennas are designed to operate in 2.4 GHz~2.5 GHz frequency band and the second antennas are designed to operate in 5.0 GHz~6.0 GHz frequency band. If the first antennas and the second antennas are of the same style, the signals within the 2.4 GHz~2.5 GHz frequency band and received by the second antennas will interfere with the first antennas, while the signals within the 5.0 GHz~6.0 GHz frequency band and received by the first antennas will interfere with the second antennas. The first antennas and the second antennas will be interfered with each other consequently if they are not provided with filtering device.

Therefore, an additional filter structure is provided to the antennas of different frequency bands to avoid the interference. The filter structure includes a signal line, a connecter, and a wave filter electrically connected to the connecter by the signal line. The individual antenna is combined with the connecter and connected with a signal input end of the wave filter, the signal output end of the wave filter is connected with a relevant electronic equipment. The signals of unwanted frequency bands are attenuated and isolated by using the individual wave filters. Therefore, the antennas of the same frequency band can operate simultaneously without the problem of noise interference.

The above-mentioned electronic equipment with the filter structure generally has an aperture on the housing thereof. The filter structure is arranged within the housing. The connecter is arranged through the aperture and exposed out of the housing. A locking component is locked with the exposed connecter so that the connecter can be connected to the signal-receiving electronic components (such as antennas) and the signals with the unwanted frequency band are attenuated and isolated by the wave filter. However, the filter structure assembled in above manner has maintenance problem. Namely, user tends to dismount the filter structure from the electronic equipment by oneself when the filter device malfunctions, this may cause damage of the electronic equipment.

Therefore, through diligent research and development process, the inventor resolve the above-mentioned problems in accordance with the above-mentioned conventional technology, that is, the objects the inventor for improving.

SUMMARY OF THE INVENTION

One object of the present invention supplies a filter device that the filter structure can be locked and fixed optionally from the outside or the inside of the housing to increase the convenience of the whole assembly.

For the above-mentioned object, the present invention supplies a filter device including: a housing provided with a through-hole; and a filter structure including: a signal line; a wave filter connected to the signal line, a size of a periphery of the wave filter being smaller than a diameter of the through-hole; and a connecter connected to one end of the signal line and connected electrically with the wave filter. The filter structure is arranged from the outside of the housing through the through-hole correspondingly, so that the signal line and the wave filter are arranged at the inside of the housing and the connecter is fixed at the through-hole.

For the above-mentioned object, the present invention supplies a filter device including: a housing provided with a through-hole; and a filter structure including: a signal line; a wave filter connected to the signal line, a size of a periphery of the wave filter being smaller than a diameter of the through-hole; and a connecter connected to one end of the signal line and connected electrically with the wave filter. The filter structure is arranged from the inside of the housing through the through-hole correspondingly, so that the signal line and the wave filter are arranged at the inside of the housing and the connecter is fixed at the through-hole.

The present invention also is provided with the following effects. The filter device can attenuate and isolate the unnecessary frequency signals by using the individual wave filters. It can be achieved to avoid the interference when the antennas of the same frequency band are used at the same time. Besides, the filter structure could be locked from the inside of the housing, so the user can not dismount the filter structure by oneself when the filter device goes wrong to avoid the damage of the filter device in favor of the following warranty identified.

DETAILED DESCRIPTION OF THE INVENTION

It will be described in more details and technical features in connection with the following drawings. The present invention is not limited to those attached drawings but for purposes of illustration only.

Figure 1:
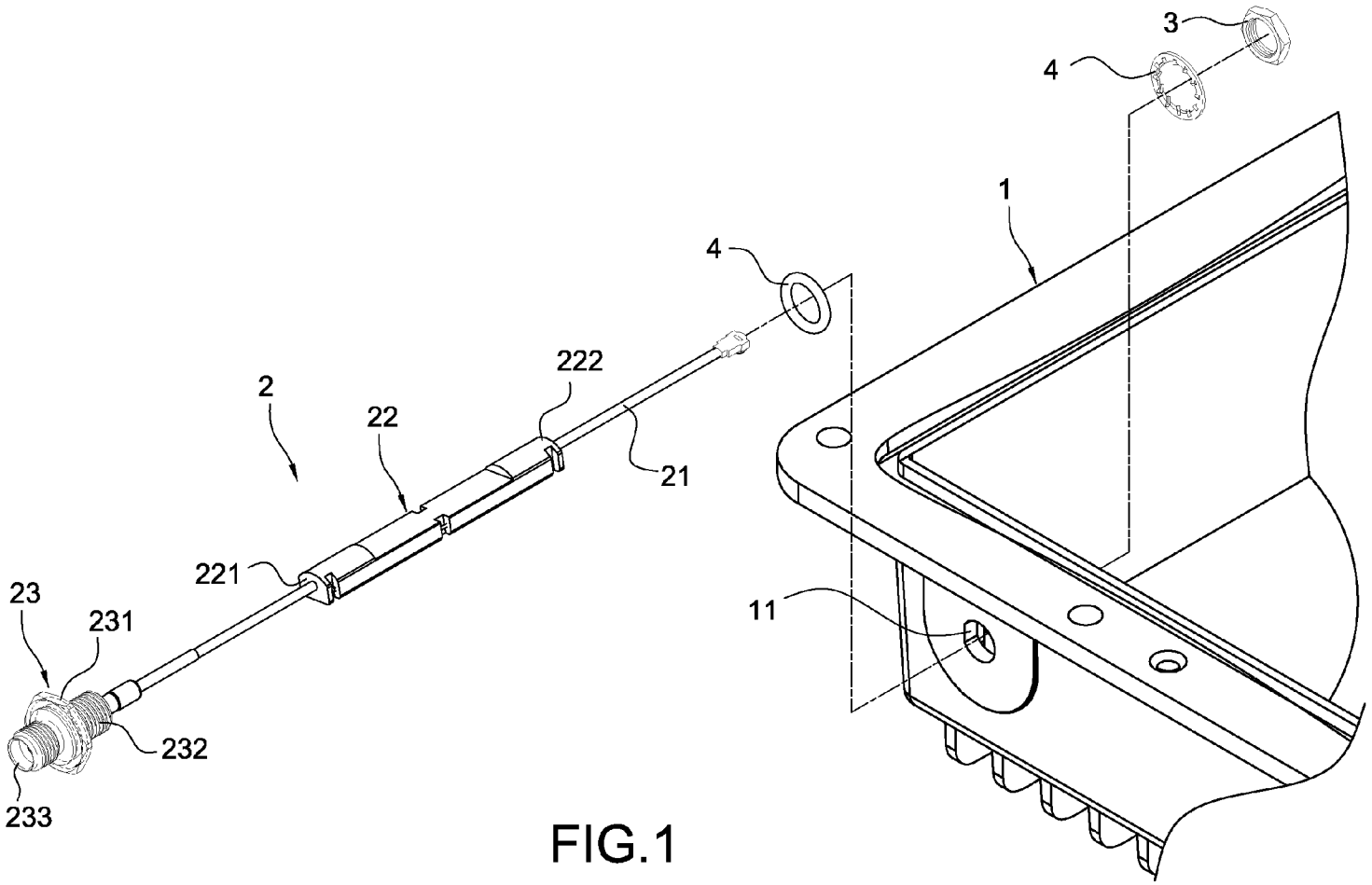
FIG. 1 is an exploded view showing the filter device of the present invention.
Figure 2:
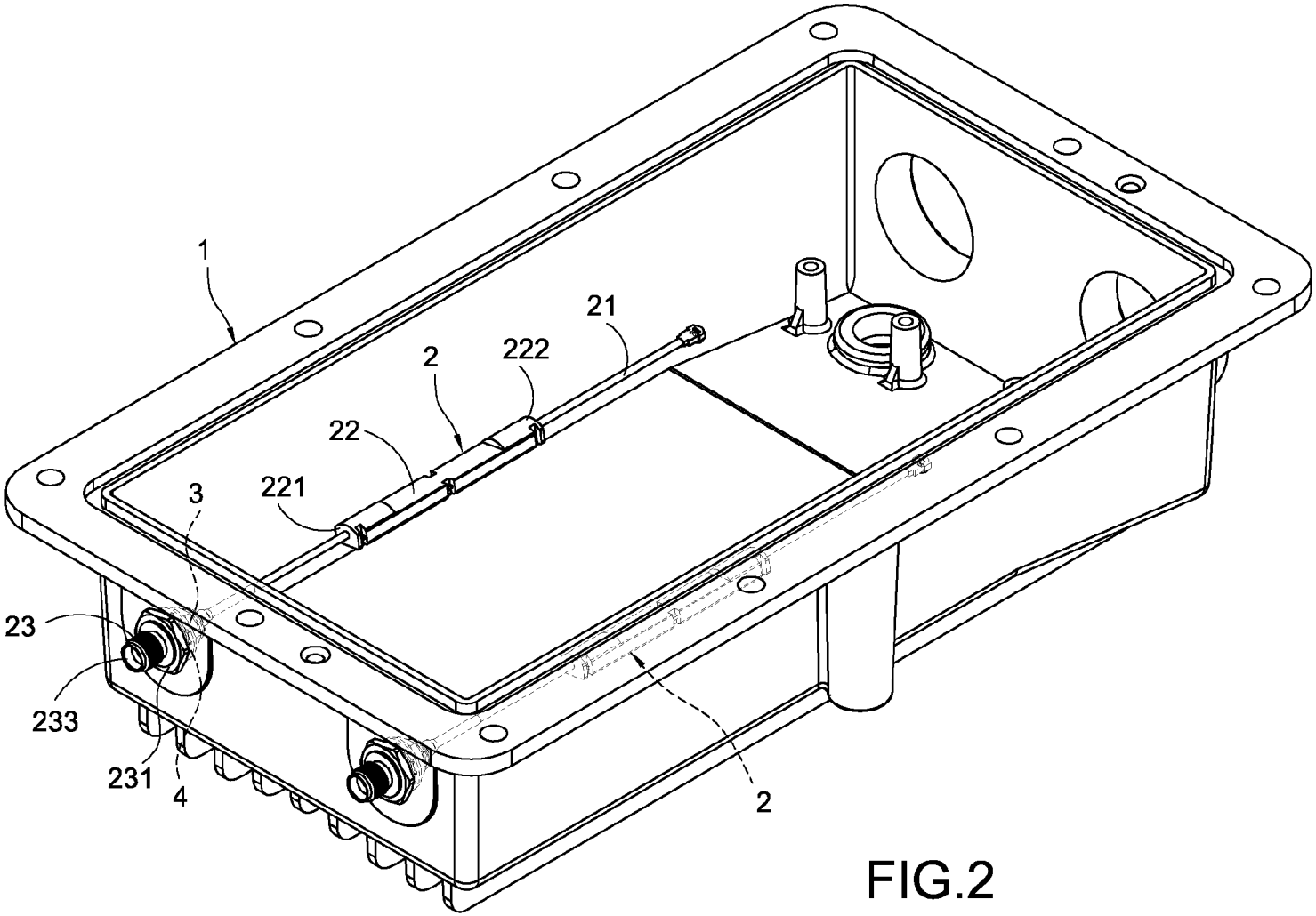
FIG. 2 is a perspective schematic view showing the filter device of the present invention.
Figure 3:
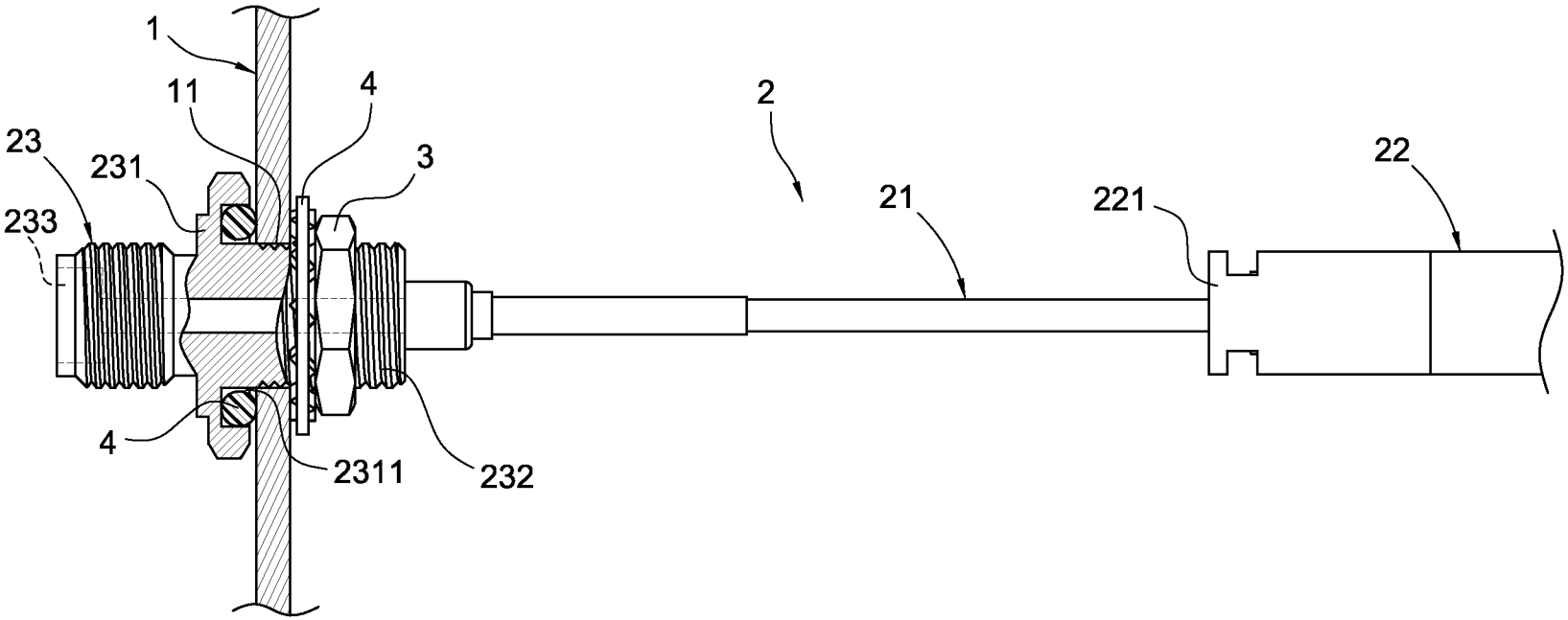
FIG. 3 is a cross-sectional schematic view showing the filter device of the present invention.

Please refer to FIG. 1 to FIG. 3, the present invention supplies a filter device, and the filter device includes a housing 1 and a filter structure 2.

The filter device is an electronic equipment with the components of the receiving signals. The electronic equipment can be any type of the electron products, such as antennas, set-up boxes or DVD players. The components of the receiving signals can be the antennas. The housing 1 is the case of the electronic equipment and provided with a through-hole 11.

The filter structure 2 includes a signal line 21; a wave filter 22 and a connecter 23. The wave filter 22 is connected to the signal line 21, and the size of the periphery of the wave filter 22 is smaller than the diameter of the through-hole 11. The connecter is connected to one end of the signal line 21 and is connected electrically with the wave filter 22. The wave filter 22 has a signal feed-in portion 221 and a signal feed-out portion 222 away from the connecter 23 in sequence. The connecter 23 is provided with a protrusion 231 where the size of the periphery is greater than the diameter of the through-hole 11. The protrusion 231 is a ring block. The protrusion 231 has a threaded rod 232 extended toward the wave filter 22, wherein a periphery size of the threaded rod 232 is smaller than the diameter of the through-hole 11 and is greater than the size of the periphery of the wave filter 22. The protrusion 231 is provided with a groove 2311 in the direction toward the wave filter 22. In addition, the protrusion 231 is provided with a transmission part 233 in the direction away from the wave filter 22.

Referred to the embodiment of the present invention, the filter structure 2 is arranged through the through-hole 11 and from the outside of the housing 1, so that the signal line 21 and the wave filter 22 are arranged at the inside of the housing 1. The connecter 23 is fixed at the through-hole 11. The filter structure 2 is arranged at the outside of the housing 1, and then the signal line 21 and the wave filter 22 are arranged at the inside of the housing 1 through the through-hole 11. At this time, the protrusion 231 and the housing 1 are locked each other, so that the transmission part 233 are exposed out of the housing 1. The present invention further includes a locking component 3. The locking component 3 is hitched in the filter structure 2 from the inside of the housing 1 and via one end of the signal line 21 away from the connecter 23. Finally, the locking component 3 is locked corresponding to the threaded rod 232, so that the connecter 23 is fixed at the through-hole 11.

Hence, the individual antennas are combined with the connecter 23 and connected with the signal feed-in portion 221 of the wave filter 22. The signal feed-out portion 222 of the wave filter 22 is connected with the relevant electronic equipment such that the individual wave filters 22 can attenuate and isolate the signals of unwanted frequency bands. It can be achieved to avoid the interference when the antennas of the same frequency band are used at the same time. Besides, the filter structure 2 could be locked from the inside of the housing 1, so the user can not dismount the filter structure 2 by oneself when the filter device malfunctions, whereby avoid the damage of the filter device can be avoided.

Furthermore, the present invention further includes two pads 4. One of the pads 4 is gripped between the locking component 3 and the housing 1, and another of the pads 4 is gripped between the protrusion 231 and the housing 1 and is interlocked corresponding to the groove 2311 to increase the stability and fitness of the assembly of the present invention.

Figure 4:
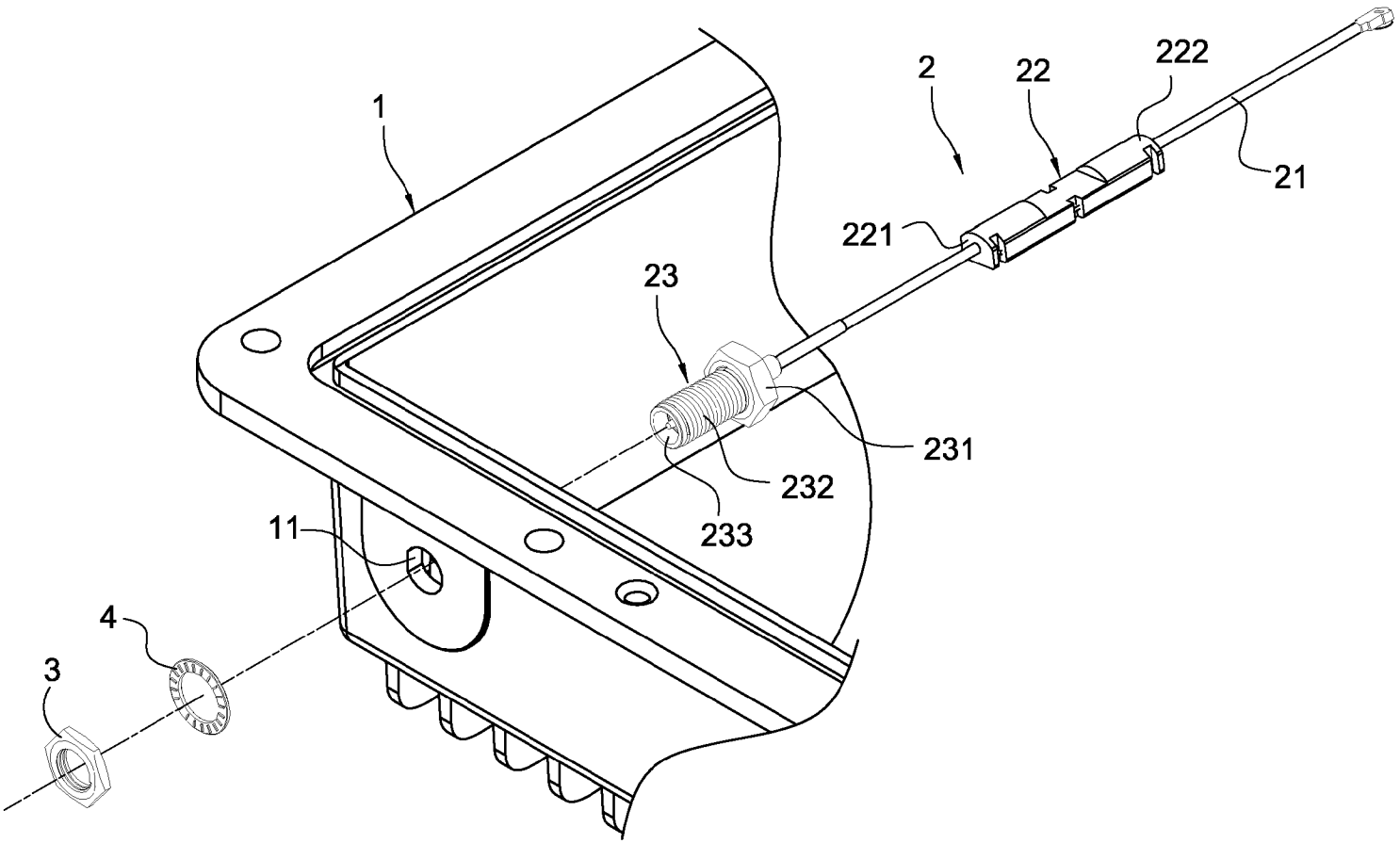
FIG. 4 is an exploded view showing the filter device of another embodiment of the present invention.
Figure 5:
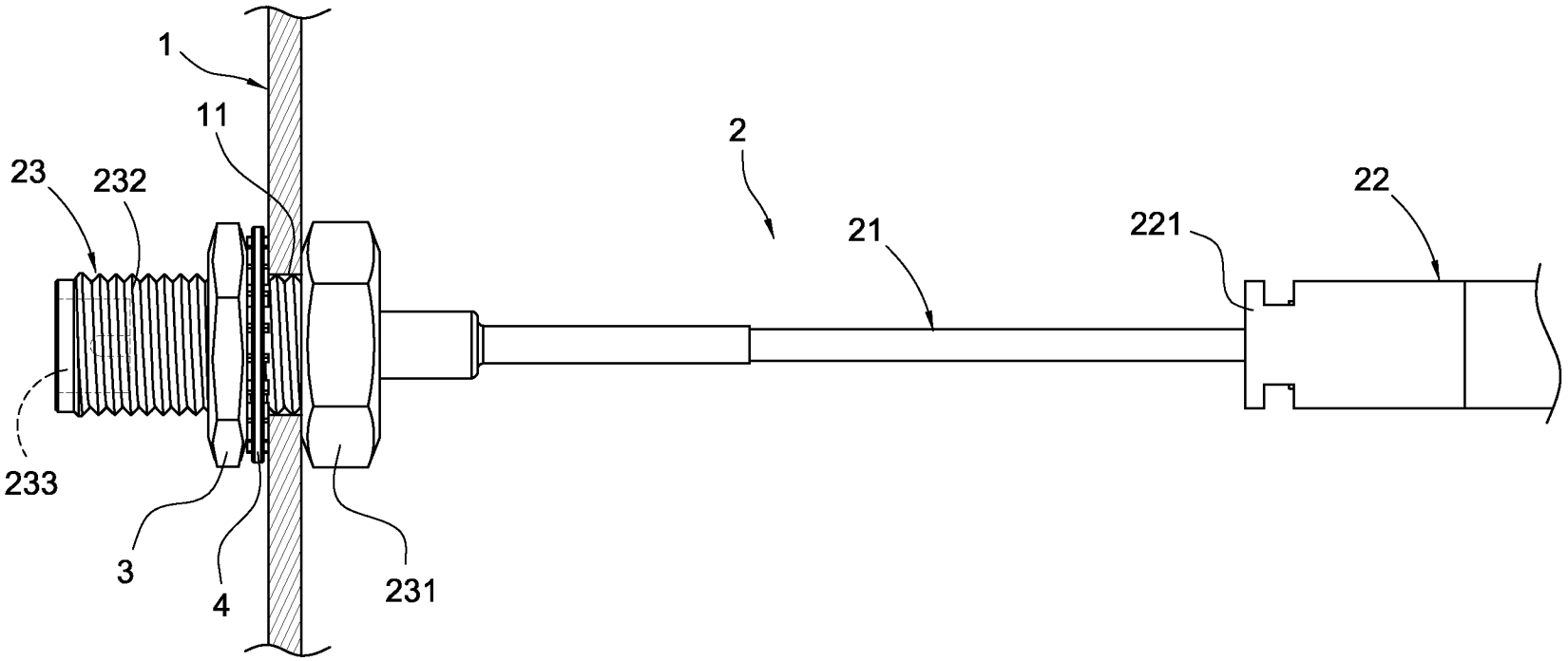
FIG. 5 is a cross-sectional schematic view showing the filter device of another embodiment of the present invention.

Please refer to FIG. 4 and FIG. 5, in another embodiment of the present invention of the filter device, a threaded rod 232 is extended from the protrusion 231 in a direction away from the wave filter 22, and a transmission part 233 is extended from the threaded rod 232 of the connecter 23.

Referred to this embodiment, the filter structure 2 is arranged through the through-hole 11 corresponding to the inside of the housing 1. The filter structure 2 is arranged at the inside of the housing 1, and then the connecter 23 is arranged through the through-hole 11 and exposed out of the housing 1. At this time, the protrusion 231 and the housing 1 are locked with each other, so that the signal line 21 and the wave filter 22 are arranged at the inside of the housing 1. The present invention further includes a locking component 3 and the pad 4. The locking component 3 and the pad 4 are hitched in the threaded rod 232 through the outside of the housing 1 via the transmission part 233. Finally, the locking component 3 is locked corresponding to the threaded rod 232, so that the connecter 23 is fixed at the through-hole 11 and the pad 4 is gripped between the locking component 3 and the housing 1. Hence, compared with the embodiment shown FIG. 1 to FIG. 3, the filter structure 2 of the present invention can be locked and fixed optionally from the outside or from the inside of the housing 1 to increase the convenience of the whole assembly.

In summary, the desired object truly can be achieved according to the filter device of the present invention to solve the defect of the conventional technology and is provided with the Novelty, Inventive steps (progressiveness) and Industrial applicability. The inventor files an application based on the Patent Law. Please exam in detail and allow the application to protect the right of the inventor.

What is claimed is:

1. A filter device including:

a housing provided with a through-hole; and a filter structure including:

a signal line;

a wave filter connected to the signal line, a size of a periphery of the wave filter being smaller than a diameter of the through-hole;

a connector connected to one end of the signal line and connected electrically with the wave filter; wherein the filter structure is arranged from the outside of the housing through the through-hole correspondingly, so that the signal line and the wave filter are arranged at the inside of the housing and the connector is fixed at the through-hole, and wherein the connector is provided with a protrusion having an exterior size greater than the diameter of the through-hole, so that the protrusion and the housing are locked with each other; and a locking component, wherein the protrusion is provided with a threaded rod having an exterior size smaller than the diameter of the through-hole and greater than the size of the periphery of the wave filter, the threaded rod extended from the protrusion in a direction toward the wave filter, and the locking component is locked corresponding to the threaded rod.

2. The filter device according to claim 1, wherein the wave filter is provided with a signal feed-in portion and a signal feed-out portion away from the connector.

3. The filter device according to claim 1, further including a pad gripped between the locking component and the housing.

4. The filter device according to claim 1, wherein the protrusion is a ring block.

5. The filter device according to claim 1, wherein the protrusion is provided with a transmission part in a direction away from the wave filter.

6. The filter device according to claim 5, further including a pad gripped between the protrusion and the housing.

7. The filter device according to claim 6, wherein the protrusion is provided with a groove and the pad is interlocked corresponding to the groove.

8. A filter device including:

a housing provided with a through-hole; and a filter structure including:

a signal line;

a wave filter connected to the signal line, a size of a periphery of the wave filter being smaller than a diameter of the through-hole;

a connector connected to one end of the signal line and connected electrically with the wave filter; wherein the filter structure is arranged from the inside of the housing through the through-hole correspondingly, so that the signal line and the wave filter are arranged at the inside of the housing and the connector is fixed at the through-hole, and wherein the connector is provided with a protrusion having an exterior greater than the diameter of the through-hole, so that the protrusion and the housing are locked each other;

a locking component, wherein a threaded rod is extended from the protrusion in a direction away from the wave filter, and the locking component is locked corresponding to the threaded rod.

9. The filter device according to claim 8, wherein the protrusion is a ring block.

10. The filter device according to claim 8, further including a pad gripped between the locking component and the housing.

11. The filter device according to claim 8, wherein the wave filter is provided with a signal feed-in portion and a signal feed-out portion away from the connector in sequence.

12. The filter device according to claim 8, wherein the connector is provided with a transmission part extended from the threaded rod.

* * * * *